US010720133B2

(12) United States Patent
Shaw

(10) Patent No.: US 10,720,133 B2
(45) Date of Patent: Jul. 21, 2020

(54) MULTIPLE COIL PICKUP SYSTEM

(71) Applicant: Fender Musical Instruments Corporation, Scottsdale, AZ (US)

(72) Inventor: Timothy P. Shaw, Hendersonville, TN (US)

(73) Assignee: FENDER MUSICAL INSTRUMENTS CORPORATION, Scottsdale, AZ (US)

( * ) Notice: Subject to any disclaimer, the term of this patent is extended or adjusted under 35 U.S.C. 154(b) by 0 days.

(21) Appl. No.: 16/103,360

(22) Filed: Aug. 14, 2018

(65) Prior Publication Data

US 2020/0058280 A1 Feb. 20, 2020

(51) Int. Cl.
*G10H 3/18* (2006.01)
*G10H 3/22* (2006.01)

(52) U.S. Cl.
CPC ..... *G10H 3/181* (2013.01); *G10H 3/22* (2013.01); *G10H 2220/515* (2013.01)

(58) Field of Classification Search
CPC .... G10H 3/181; G10H 2220/505; G10H 3/18; G10H 2220/511; G10H 2220/461; G10H 2220/565
See application file for complete search history.

(56) References Cited

U.S. PATENT DOCUMENTS 4,175,462 A 11/1979 Simon
4,809,578 A 3/1989 Lace, Jr.
5,136,918 A 8/1992 Riboloff
5,136,919 A 8/1992 Wolstein
5,311,806 A 5/1994 Riboloff
5,376,754 A 12/1994 Stich
5,763,808 A 6/1998 Thomson
5,789,691 A 8/1998 Stich
5,834,671 A 11/1998 Phoenix
6,034,316 A * 3/2000 Hoover ..... G10H 3/186 84/738
6,121,537 A * 9/2000 Pawar ..... G10H 3/182 84/728
8,309,836 B1 11/2012 Bolger et al.
9,704,464 B1 7/2017 Petschulat
9,747,882 B1 8/2017 Micek
9,837,063 B1 12/2017 Feese
10,446,130 B1 * 10/2019 Shaw ..... G10H 3/181
2002/0069749 A1 * 6/2002 Hoover ..... G10H 3/26 84/738

(Continued)

*Primary Examiner* — Marlon T Fletcher
(74) *Attorney, Agent, or Firm* — Hall Estill Attorneys at Law; Tyler J. Mantooth

(57) ABSTRACT

A stringed instrument pickup with multiple selectable coils can be utilized in a system to provide a diverse range of sound characteristics from at least one moving string under tension. A first wire can be connected to a first terminal of a first bobbin body prior to the first wire being wound around the first bobbin body a first number of times and then connecting the first wire to a second terminal of the first bobbin body. A second wire may be connected to the second terminal of the first bobbin body before winding the second wire around the first bobbin body a second number of times and then connecting the second wire to a third terminal of the first bobbin body. The first bobbin body is subsequently mounted onto a stringed instrument.

19 Claims, 6 Drawing Sheets

(56) References Cited

U.S. PATENT DOCUMENTS

| | | | | |
|---|---|---|---|---|
| 2005/0087063 | A1* | 4/2005 | Bryce | G10H 3/182 84/742 |
| 2005/0150364 | A1 | 7/2005 | Krozack et al. | |
| 2006/0011051 | A1* | 1/2006 | Aivbrosino | G10H 1/18 84/742 |
| 2006/0156911 | A1* | 7/2006 | Stich | G10H 3/181 84/726 |
| 2012/0036983 | A1* | 2/2012 | Ambrosino | G10H 3/143 84/731 |
| 2014/0041514 | A1* | 2/2014 | Gross | G10H 3/181 84/726 |
| 2014/0245877 | A1* | 9/2014 | Gelvin | G10H 3/181 84/727 |
| 2015/0107444 | A1* | 4/2015 | Pezeshkian | G10H 1/34 84/645 |
| 2015/0371624 | A1* | 12/2015 | Wolf | G10H 3/181 84/318 |
| 2016/0027422 | A1* | 1/2016 | Baker | G10H 3/22 84/726 |
| 2018/0102121 | A1 | 4/2018 | Shaw et al. | |
| 2020/0058280 | A1* | 2/2020 | Shaw | G10H 3/22 |

* cited by examiner

FIG. 10A
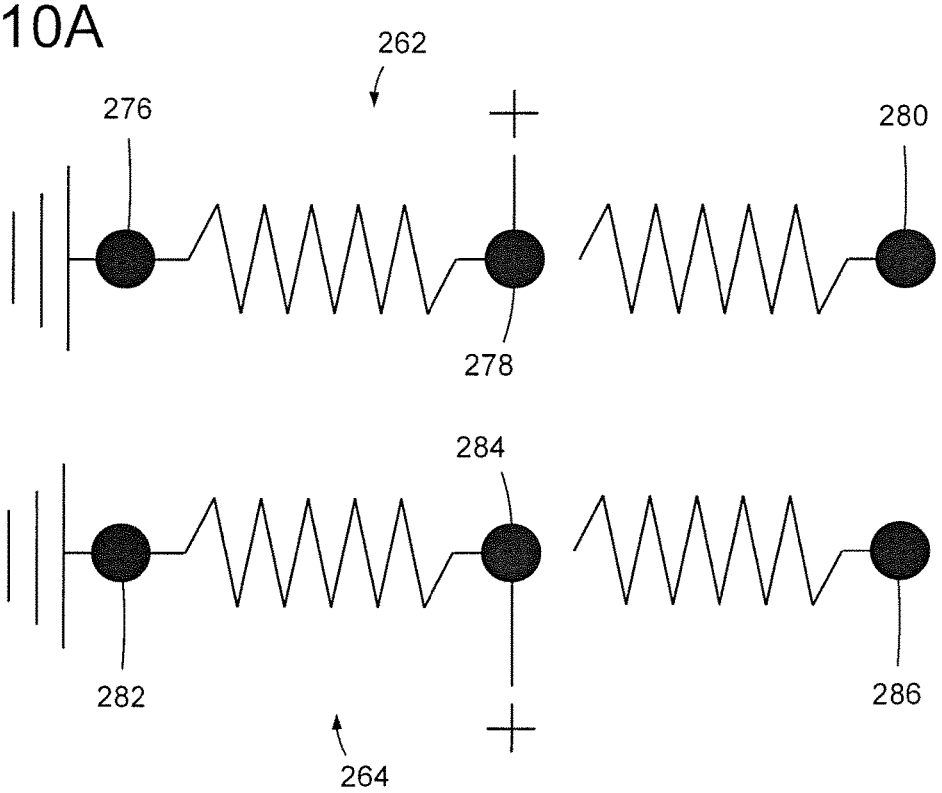
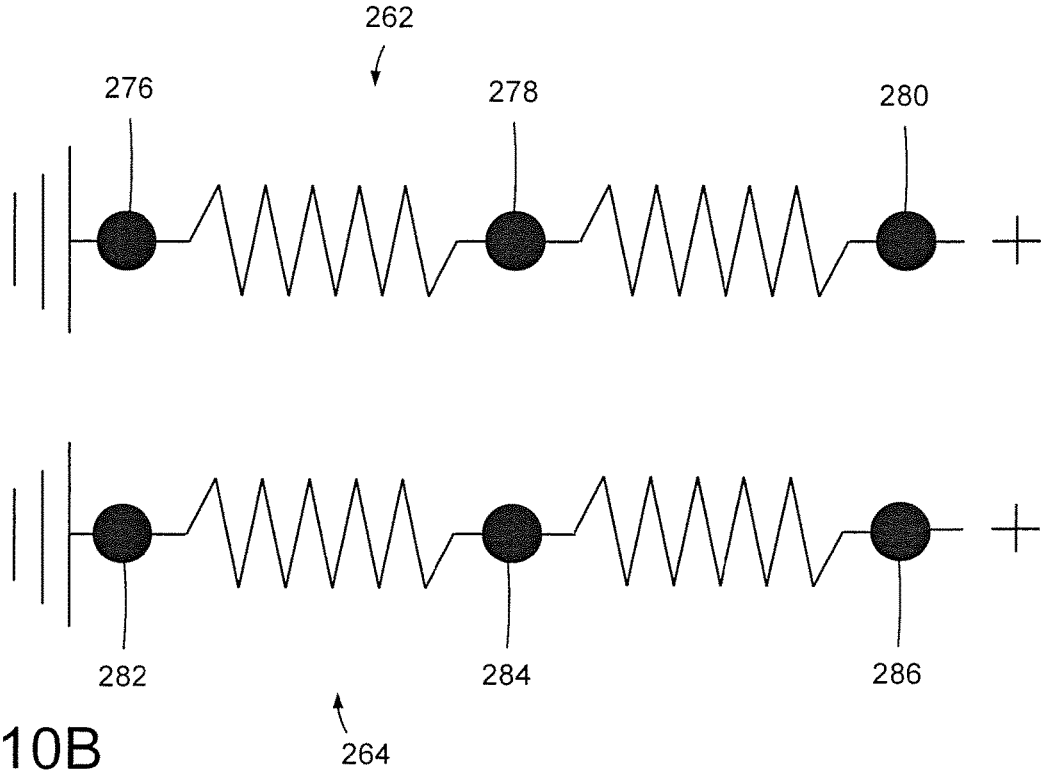
FIG. 10B

MULTIPLE COIL PICKUP SYSTEM

SUMMARY

A system for utilizing a stringed instrument pickup with multiple coils involves, in some embodiments, connecting a first end of a first coil to a terminal of a bobbin body. The coil is wound around the bobbin body a predetermined number of times and a second end of the first coil is electrically connected to a second terminal of the bobbin body. A first end of a second coil is connected to the second terminal and wound around the bobbin body before being connected to a third terminal. The first, second, and third terminals extending from the bobbin body are each connected to a selector that allows the first and second coils to be active individually or concurrently.

In other embodiments, a pickup system employs multiple coils wound around a single bobbin body to allow the respective coils to be selected via separate terminals extending from the single bobbin body. A user alters how a magnetic field contributes to the electrical output, and sound characteristics, from string motion by activating the second coil.

A pickup with multiple coils can be incorporated into a stringed instrument as part of an optimized musical system operated in accordance with various embodiments. A first pickup is constructed with a first coil extending between a first pair of terminals and a second coil extending between a second pair of terminals on a single bobbin body. The first pickup is mounted to a body of a stringed instrument in a position separated from a second pickup. A user selects the second coil of the first pickup to alter how a magnetic field reacts to detected string motion to generate electrical output.

BRIEF DESCRIPTION OF THE DRAWINGS

FIGS. 10A & 10B respectively provide electrically operational schematics of an example stringed instrument pickup configured in accordance with various embodiments.

DETAILED DESCRIPTION

Assorted embodiments of the present disclosure are directed to a stringed instrument pickup consisting of multiple coils being utilized in a musical system to provide optimized generation of electrical signals in response to an instrument being played.

A stringed instrument pickup is a structure that converts movement of a tensioned string into electrical signals. Numerous different pickup structures and configurations have been utilized to customize the manner in which string motion and vibration is captured in an output electrical signal. However, the past arrangements for a single pickup have been static and failed to provide options for a user to customize the outputted electrical signal that are subsequently reproduced as audible sound, such as music.

While numerous different pickups can be positioned on a stringed instrument to provide different selectable characteristics for generating electrical signals, such pickups occupy valuable real estate on a stringed instrument and can have degraded sound quality due to the placement of the pickup(s) relative to the tensioned strings. In addition, positioning a pickup under a different section of the instrument strings can change the sound of the pickup as the harmonic mix of the string's output changes due to where the pickup is physically located relative to the string tensioning bridge of the instrument. By incorporating multiple coils into a single bobbin assembly, a user can select a diverse variety of means for translating string motion into electrical signals with a single pickup. The ability to customize the various coils of a bobbin assembly can additionally provide precise, or vast, alterations to the manner in which electrical signals are generated from string motion, which can optimize musical reproduction without the need for external signal processing, such as a pedal, mixer, or other circuitry.

Accordingly, embodiments of the present disclosure are directed to a single stringed instrument pickup that provides options for a user to customize the manner in which a played instrument string is captured by the pickup. By activating multiple different coils in a single bobbin, multiple coil sizes, and potentially coil shapes, can be employed with a single pickup to provide customized pickup structure and electrical signal generation in response to instrument string motion in the customized magnetic field. As such, the ability to select different pickup coils provides selectable electrical impedance and magnetic fields that translate string motion with different output signals that optimize music generation and playback.

Figure 1:
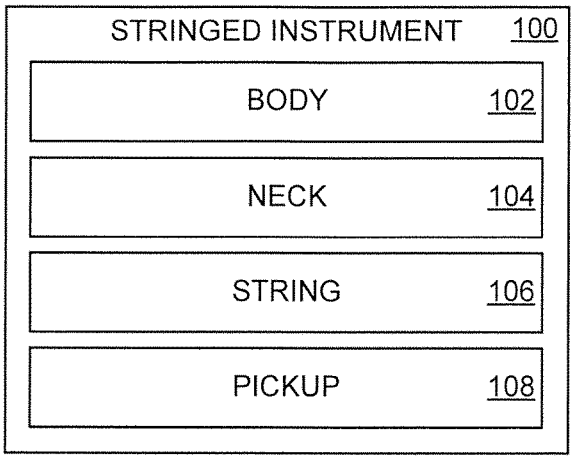
FIG. 1 displays a block representation of an example stringed instrument that may be employed in accordance with various embodiments.

An example stringed instrument 100 is conveyed in FIG. 1 with a body 102 connected to a neck 104. It is noted that the body 102 can be any size, shape, and volume to provide a variety of sound characteristics in response to motion of one or more strings 106 that continuously extend from the neck 104. While the strings 106 can acoustically resonate with the volume of air in the body 102, various embodiments position an electrical pickup 108 proximal the strings 106 to generate electrical signals to represent the sound properties of the vibrating string(s) 106. Hence, various embodiments are directed to utilizing a pickup in a solid body, or semi-solid body, stringed instrument, such as a guitar.

The pickup 108 is configured to have a magnetic field that is influenced by movement of a string 106 and such magnetic activity is translated to electrical signals by a coil with such electrical signals being subsequently used by other audio equipment, such as an amplifier, speaker, or control board, to produce sound. However, the clarity and sonic accuracy of stringed instrument pickups 108 have traditionally been imprecise. That is, the generated magnetic field and how it reacts to vibrating strings 108 in assorted configurations have not been able to accurately represent sound as if a user was listening to string motion in-person. For example, a pickup 108 can be constructed to be very accurate for a relatively narrow range of frequencies, but struggle to convey the other frequencies produced by string 106 motion. In another example, a pickup 108 can have relatively high sensitivity, which increases the strength of the representative electrical signal, but at the cost of losing the breadth and depth of the sound properties of the moving and/or vibrating string(s) 106.

Figure 2:
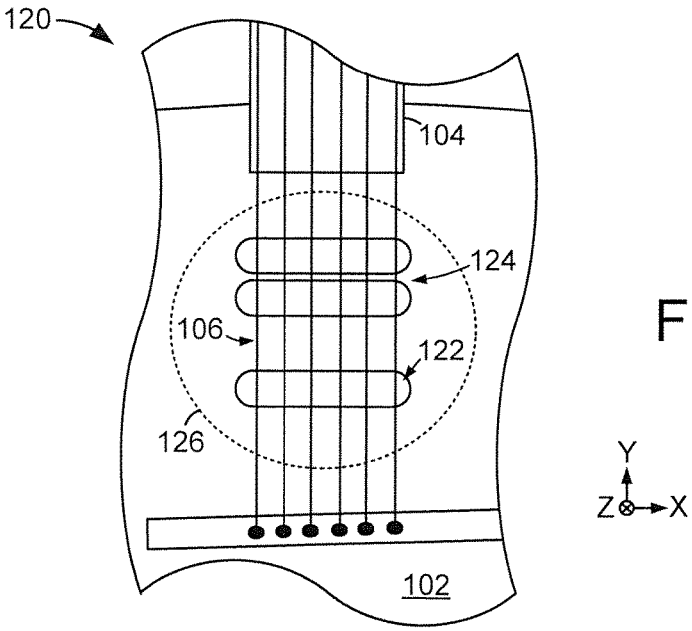
FIG. 2 represents portions of an example guitar stringed instrument in which some embodiment may be employed.

With these issues in mind, many stringed instruments 100 employ multiple pickups 108 in an attempt to provide diversity in the manner in which string 106 motion is captured into electrical signals via magnetic and electrical aspects of a pickup 108. FIG. 2 displays a portion of an example guitar 120 stringed instrument that employs a first pickup 122 and a second pickup 124 to sense movement from one or more strings 106 suspended over a body 102 of the guitar 120. It is contemplated that one or more pickups 122/124 can be utilized in an acoustic, or hollow, body guitar, as represented by segmented sound hole 126. However, assorted embodiments are directed to a pickup secured to a solid, or semi-hollow, guitar body 102.

With the implementation of multiple pickups 122/124 into a guitar 120 a user can select one or more of the pickups 122/124 to be active while playing the strings 106. For example, a selector, such as a button knob, lever, or switch, can be located on the guitar 120 to allow activation of a single pickup 122 or multiple pickups 122/124 concurrently. In the non-limiting example shown in FIG. 2, a single coil pickup 122 is complemented by a humbucking pickup 124 that provide different electrical and magnetic characteristics that translate into unique reproduced sound from the vibrating strings 106. It is noted that two, or more single coil pickups with different configurations and/or acoustic capturing characteristics can alternatively be used.

Although any number, and type, of pickup can be employed in a single guitar 120 the magnetic signature and electrical operation of pickups can be degraded if the pickups are positioned in close physical proximity. Thus, the physical size of the area under the strings 106 can limit how many pickups can be utilized to provide sonic options for a user.

Figure 3:
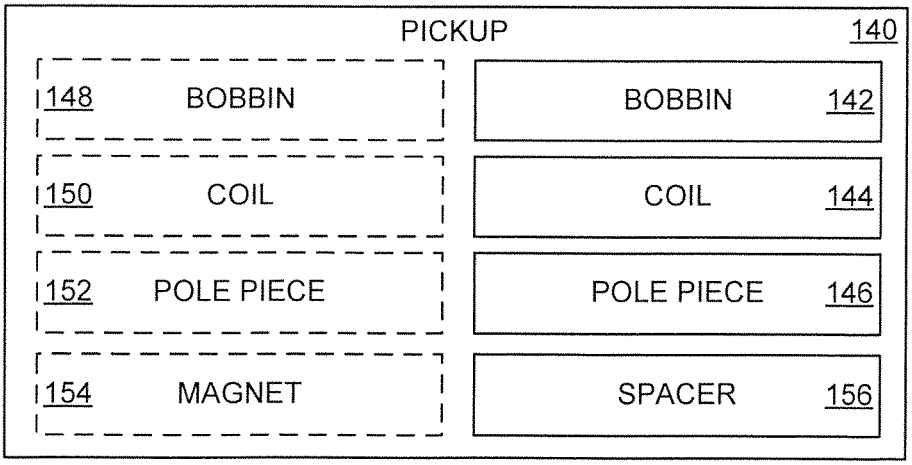
FIG. 3 depicts a block representation of an example pickup capable of being used in the stringed instruments of FIGS. 1 and 2 in accordance with some embodiments.

Accordingly, assorted embodiments are directed to a single pickup that is configured with multiple selectable coils that provide greater electrical, magnetic, and sound control to a guitar user. FIG. 3 is a block representation of an example pickup 140 that can be utilized in a stringed instrument, such as a guitar, cello, violin, banjo, or bass. The pickup 140 has a bobbin 142 that positions a coil 144 of electrically conductive wire, such as copper, iron, silver, or gold, to surround a number of pole piece 146. It is contemplated that the pole piece 146 are constructed of a ferrous material, such as iron or steel, with one pole piece 146 is positioned proximal to, and in vertical alignment with, each string of the instrument, as shown in FIG. 2. In another embodiment, a single ferrous bar may continuously extend below, and in vertical alignment with, all the strings of an instrument. Other embodiments may replace a ferrous pole piece, or ferrous bars, with one or more magnets with customized magnetic properties, such as strength and coercivity.

In a humbucking configuration, as shown by segmented boxes, has a second bobbin 148 that separates and positions pole pieces 150 from a coil 152. One or more magnets 154 can be placed between the bobbins 142/148, sometimes in combination with one or more spacers, or shims, 156 so that the magnetic polarity of one coil 144 is the opposite of the other coil 152 and the bobbin assemblies 142/148 are out-of-phase. It is contemplated that individual bobbins 142/148 of a humbucker pickup configuration can be selected. As such, a pickup 140 can be configured to allow each bobbin 142/148 to be a combined single pickup or selectable single coil pickups to sense motion of adjacent string(s) 106 in different ways.

Figure 4:
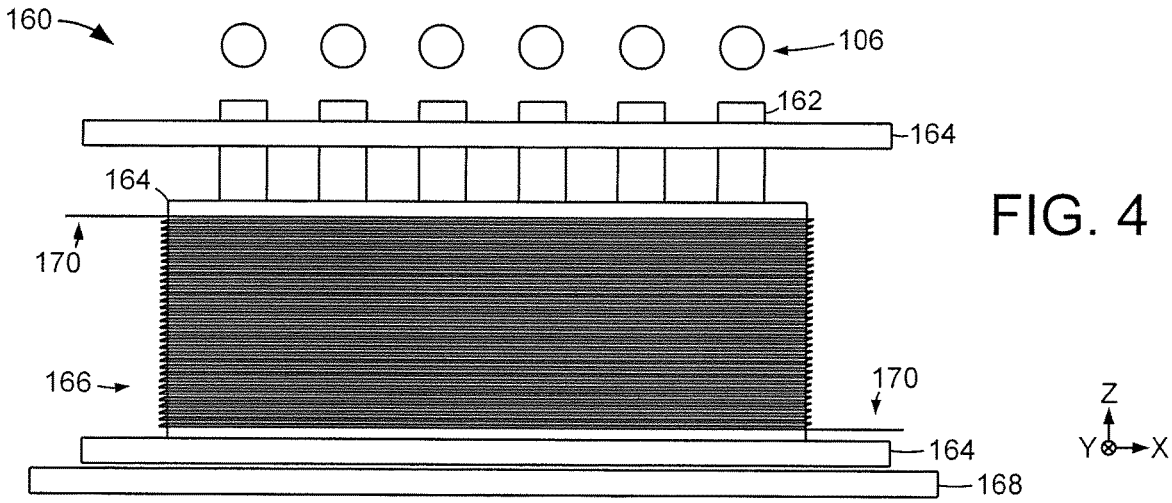
FIG. 4 is a partially exploded line representation of portions of an example pickup arranged in accordance with assorted embodiments.

FIG. 4 illustrates a partially exploded line representation of portions of an example stringed instrument pickup 160 that is arranged in accordance with various embodiments. The exploded aspects of the pickup 160 show how pole pieces 162 are secured within a bobbin 164 so that each 162 is proximal to, and separated from, a string 106 and a coil 166. The coil 166 consists of a continuous electrical wire that is wrapped continuously around the periphery of the bobbin 164 a predetermined number of times, such as 5000, 5500, or 2500 turns at a uniform tension around the perimeter of a coil region that is less than all of the bobbin 164.

Figure 5:
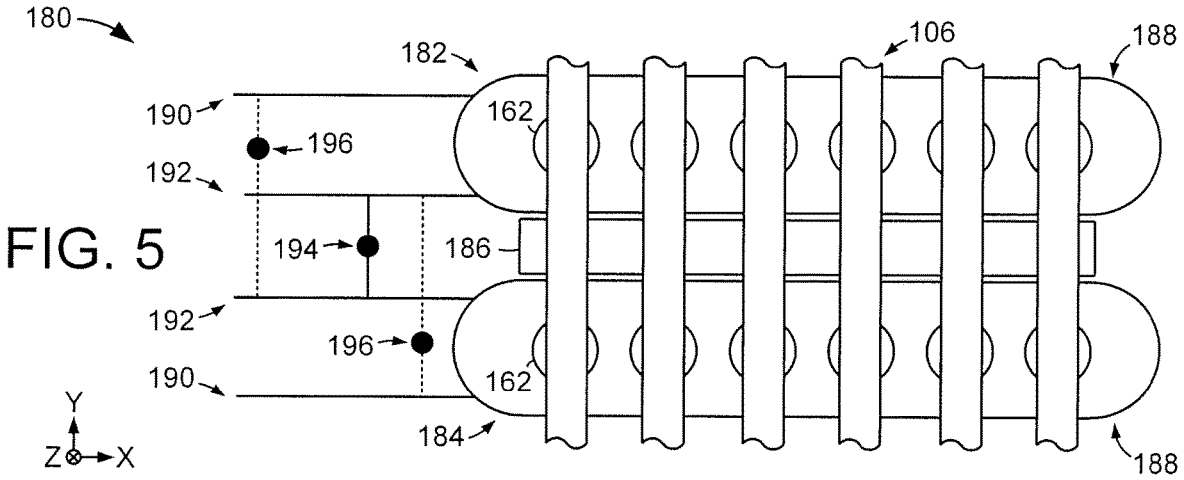
FIG. 5 conveys a top view line representation of portions of an example pickup constructed and operated in accordance with some embodiments.

The bobbin 164, as shown, can be secured to a baseplate 168 that can provide structural rigidity and electrical contact terminals for the respective ends 170 of the coil 166. For instance, a positive end and negative end of the coil 166 can be attached to the baseplate 168 to allow for efficient and reliable electrical connections to a selector and/or output, such as a cable jack. FIG. 5 displays a top view line representation of an example humbucking pickup 180 that is wired in various configurations to provide different sonic impressions from string 106 motion. The pickup 180 has a first bobbin 182 separated from a second bobbin 184 by a magnet structure 186.

Each bobbin 182/184 has a single electrically conductive coil 188, in the non-limiting example of FIG. 5, that consists of a continuous wire that has a first end 190 and a second end 192. By connecting the second end 192 of the coil 188 of the first bobbin 182 to the first end 190 of coil 188 of the second bobbin 184, as represented by solid terminal 194, the coils 188 are connected in series and the electrical signals produced by the pickup 180 will generate different streams of electrical signals in response to string motion due to the impedance of the aggregate total of the coils 188. It is contemplated that such streams of electrical signals can have more prominent low and midrange audible frequencies, attenuated frequencies, and otherwise electric representation of what an in-person human ear would hear from the string motion.

Connecting the first ends 190 of each coil 188 and the second ends 192 of each coil 188, as represented by segmented terminals 196, provides a parallel wiring configuration that produces a different electrical output than the series wiring configuration, which can produce different sound characteristics when a generated stream of electrical signals is outputted as sound, such as more prominent higher audible frequencies. While it is contemplated that a selector can be connected to the pickup 180 to allow for activation of either series or parallel wiring configuration, the ability to select two different magnetic fields for a pickup 180 with two bobbins 182/184 and coils 188 is relatively expensive in terms of physical size. Accordingly, various embodiments are directed to a coil and bobbin assembly that provides a user with more diverse magnetic field behavior with greater range of electrical outputs resulting from proximal string motion compared to either in a single bobbin pickup or a humbucking pickup.

Figure 6:
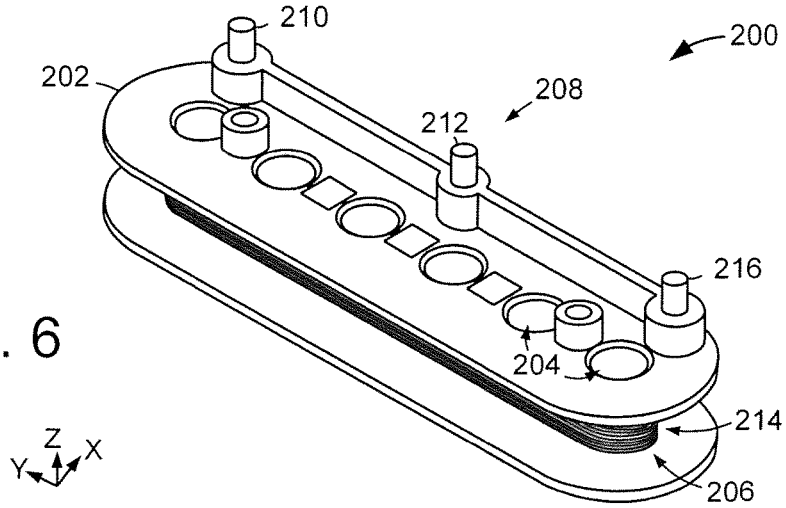
FIG. 6 illustrates a line representation of portions of an example bobbin assembly that can be utilized in a pickup in accordance with various embodiments.

FIG. 6 conveys a line representation of an example bobbin assembly 200 configured in accordance with some embodiments. The bobbin assembly 200 has a single bobbin body 202 that physically contacts and supports a plurality of string pole pieces 204, wound wire 206, and a plurality of electrical wire terminals 208. It is contemplated that the bobbin body 202 is a unitary component or an assembly of multiple pieces that is not electrically or magnetically conductive. Each pole piece 204 is magnetically conductive and can be electrically separated, or electrically connected to, current flowing through the electrically conductive wire. In some embodiments, the coil comprising of the wound wire 206 physically contacts one or more of the pole pieces 204.

Although the wound wire 206 may be continuous to define a single coil of a predetermined number of turns, such as 2500 or 5000 circumferential passes completely around the bobbin body 202, multiple coils can be provided by the bobbin assembly 200 by connecting different ends of wire 206 to the respective terminals. For instance, a first wire 206 can continuously extend from a first electrically conductive terminal 210 to a second electrically conductive terminal 212 to form a first coil and a second wire 214 can continuously extend from the second terminal 212 to third terminal 216 to form a second coil. Hence, the single bobbin body 202 concurrently supports multiple wire coils that can be independently, and concurrently, activated via the terminals 210/212/216.

With the bobbin body 202 sporting multiple selectable coils, the assembly 202 provides increased signal generation, impedance, and magnetic field behavior without taking up valuable real estate in an instrument body. It is noted that the bobbin assembly 200 can be constructed with more than two selectable coils. For instance, three coils can be activated via four separate terminals or five coils can be activated via six terminals. It is contemplated that a tap wire can extend from a terminal 208 to a tap in the wire 206/214 instead of having multiple wire ends connected to a common terminal.

Figure 7:
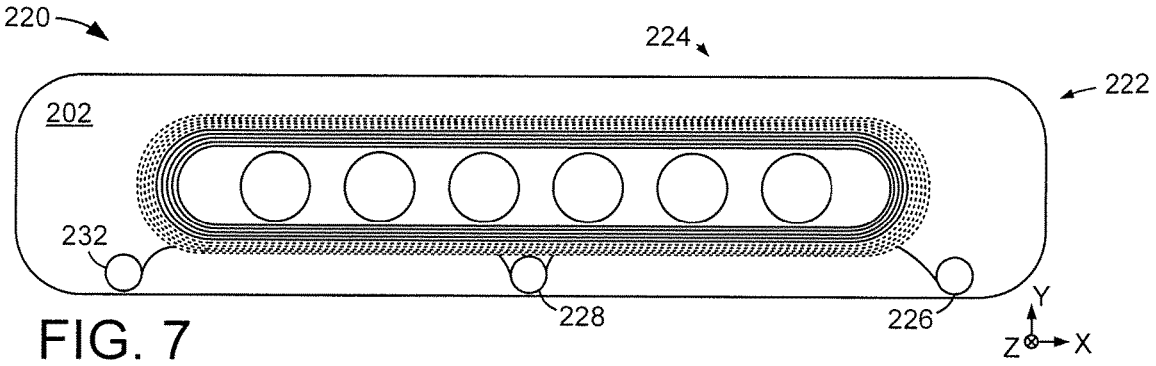
FIG. 7 shows a top view line representation of portions of an example bobbin assembly configured in accordance with assorted embodiments.

FIG. 7 is a top view line representation of portions of an example bobbin assembly 220 that employs multiple concentric wire coils 222 and 224 in accordance with assorted embodiments. A first coil 222, as shown by solid lines, is wound about a center section 224 of the bobbin body 202 and is connected between two separate terminals 226 and 228. A second coil 230, as shown by segmented line, is wound in physical contact with the first coil 222 and is connected between two separate terminals 228 and 232, which may, or may not, be connected to the first coil 222. The respective coils 222/224 can be configured to have a matching, or dissimilar, impedance that corresponds with the length of wire extending between terminals 208. As such, the coils 222/224 can have different, or matching, lengths that correspond with the number of turns about the bobbin body 202.

It is contemplated that the coils 222/224 may be constructed of different materials, wire gauges, or electrically conducting properties. As a non-limiting example, a first coil 222 has 5000 turns and is constructed of copper while the second coil 224 has 2000 turns and is constructed of silver to provide different electrical impedances for selection by a user. The presence of multiple different coils in a single bobbin assembly 220 allows at least four configurable impedances, and corresponding magnetic fields, responding to instrument string 106 motion. That is, a user can select the first coil 222 alone, second coil 224 alone, the coils 222/224 connected in series, or the coils 222/224 connected in parallel via the various terminals provided by the bobbin body 202 to provide differing manners of translating string 106 motion into a stream of electrical signals.

Figure 8:
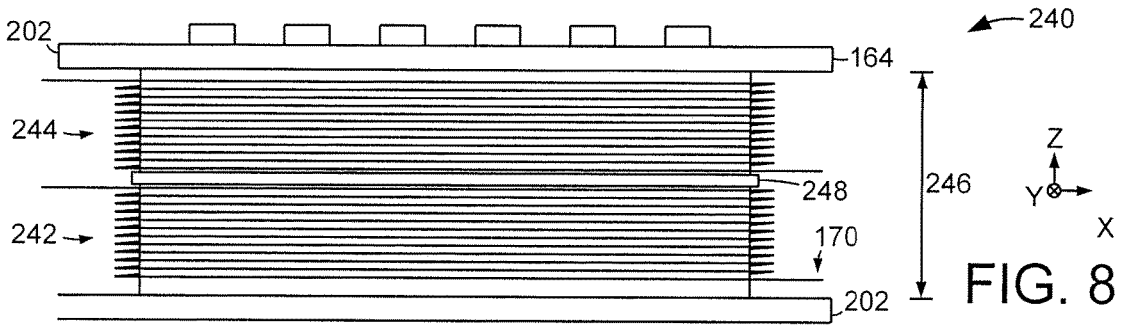
FIG. 8 displays portions of an example bobbin assembly that may be incorporated into a stringed instrument pickup.

FIG. 8 depicts a line representation of portions of another example bobbin assembly 230 arranged with multiple coils 242 and 244 in accordance with some embodiments. As shown, a first coil 242 is wrapped around a first half of the thickness 246 of the bobbin body 202 while a second coil 244 is wrapped around a second half of the body thickness 246. By physically separating the coils 242/244 on different portions of the bobbin thickness 246 with a spacer 248, such as a ridge, protrusion, or other physical stop, the magnetic field and resulting relationship with adjacent string 106 motion that generates electrical signals can be different than if the coils 242/244 physically contacted each other, such as the example embodiment of assembly 220.

The physical separation of coils 242/244 can correspond with matching coil configurations. For instance, the coils 242/244 can be constructed of the same material and wrapped about the body 202 for a matching number of turns, at least within a range of tolerance, such as within 5% of the overall amount of turns or 2% of the overall length of wound wire. The ability to customize the construction of the coils 242/244 to be different or matching provides a wide range of selectable magnetic field properties due as a product of activating a single coil or multiple coils 242/244. It is contemplated that the wire can pass through internal cavities in the bobbin body 202, or otherwise be electrically and/or magnetically insulated from the wire of the other coil, to reach a terminal 226/228/232 positioned on the bottom of the body 202, which prevents the coils from physically touching or interfering (electrically and/or magnetically) with one another during activation.

Figure 9A:
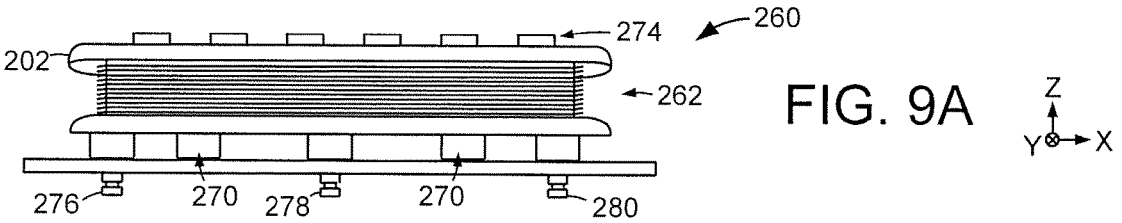
FIGS. 9A-9C represent an example stringed instrument pickup arranged in accordance with some embodiments.
Figure 9B:
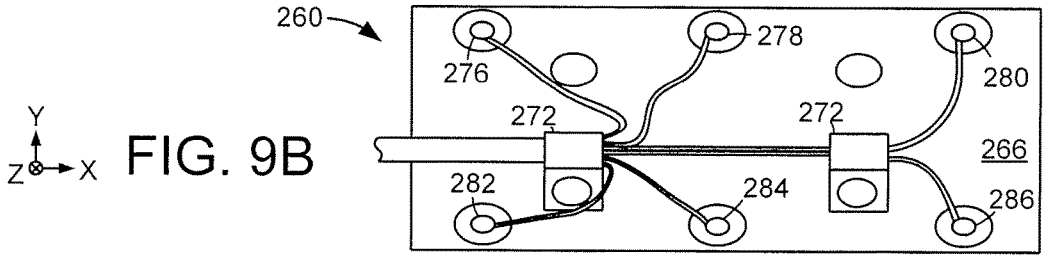
Figure 9C:
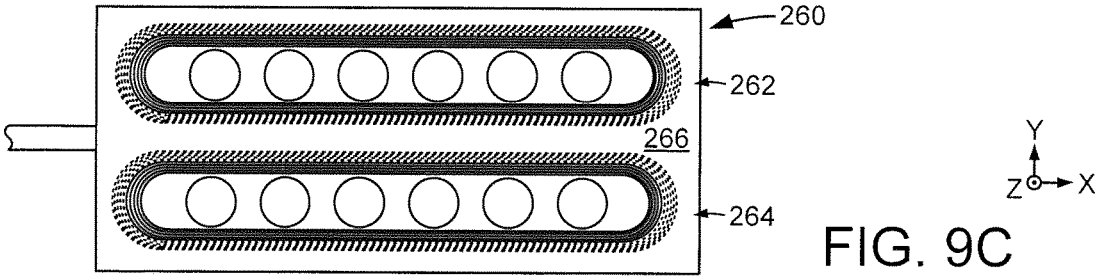

A bobbin assembly with multiple selectable coils can be employed in a stringed instrument alone. However, some embodiments pair one or more bobbin assemblies together with additional structure. FIGS. 9A-9C respectively convey line representations of various aspects of an example instrument pickup 260 arranged for humbucking operation, although non-humbucking operation are possible when a single bobbin assembly is mounted to a stringed instrument. The pickup 260 has a first bobbin assembly 262, as shown in the side view of FIG. 9A, and a second bobbin assembly 264, as shown in FIG. 9B, that each physically attach to a common baseplate 266. The baseplate 266 provides increased structural rigidity and electrical connection integrity compared to if a bobbin assembly 262/264 was mounted to an instrument body alone.

The bottom view of the pickup 260 shown in FIG. 9B illustrates how the baseplate 266 may also provide electrical interconnection pathways to connect directly to the terminals extending from the respective bobbin assemblies 262/264 or to various plate terminals 268 that physically contact the terminals of the respective bobbin assemblies 262/264. That is, the baseplate 266 can consist of its own terminals 268 that contact the bobbin terminals or can consist of apertures through which the bobbin terminals extend when mounted to the baseplate 266.

In the non-limiting embodiment where the baseplate 266 comprises plate terminals 268, the respective plate terminals 268 can physically contact the respective bobbin terminals 208. Regardless of whether the baseplate 266 consists of plate terminals 268, the physical separation of terminals corresponding to different coils allows one or more coils of the bobbin assemblies 262/264 to be activated via electrical interconnections that are fixed in place by at least one support 270. It is noted that in operation the respective bobbin assemblies 262/264 will each be rotated so that the electrical terminals physically contact the corresponding plate terminals 268 and the pole pieces 272 face and are vertically aligned with instrument strings 106, as generally shown in FIGS. 4 & 5.

The respective bobbin assemblies 262/264 can be secured to the baseplate 266 with one or more fasteners, such as rivets, screws, pins, tabs, or retainers. It is contemplated that one or more bobbin assemblies 262/264 are mounted atop at least one spring, or other suspension, that dampens movement and positioning the pole pieces 272 a predetermined distance from the respective instrument strings. The baseplate 266 may also be mounted to the body, or neck, of a stringed instrument with one or more fasteners and may employ a motion, and/or vibration, dampening suspension.

The assorted views of the pickup 260 shown in FIGS. 9A-9C illustrate how the respective bobbin assemblies 262/264 attach to the baseplate 266 to provide a single, unitary pickup structure. The top view of FIG. 9C shows how each bobbin assembly 262/264 can comprise multiple concentric coils of electrically conductive wire, as represented solid and segmented wire paths around the respective bobbin bodies 202.

Once the pickup is assembled with the bobbin assemblies 262/264 mounted to the baseplate 266 with the various plate terminals 268 electrically connected to the bobbin terminals 208, a user can selectively activate a diverse variety of coils that correspond with different electrical impedances, magnetic fields, and sound characteristics captured in electrical signals outputted by the pickup 260. In the non-limiting example pickup 260 configuration shown in FIG. 9B, terminal 276 is a start of a first coil of the first bobbin assembly 262, terminal 278 is connected to the first coil and a second coil of the first bobbin assembly 262, and terminal 280 is the end of the second coil of the first bobbin assembly 262. Similarly, terminal 282 is a start of a first coil of the second bobbin assembly 264, terminal 284 is the end of the first coil and the beginning of a second coil of the second bobbin assembly 264, and terminal 286 is the end of the second coil of the second bobbin assembly 264.

By selecting any two of the three plate terminals 276/278/280 corresponding to the first bobbin assembly 262, or terminals 282/284/286 corresponding to the second bobbin assembly 264, different numbers of coils, and lengths of conducting wire acting as an electrical resistor, receive electrical current that produces different coil configurations that respond differently to vibrations and movement of adjacent strings 106 to produce different sound characteristics in the generated electrical signals. FIGS. 10A and 10B respectively display schematics of example operation of the humbucking pickup 260 of FIG. 9. In FIG. 10A, a first bobbin assembly 262 activates a single coil between two plate terminals 274 and 276 and a single coil of the second bobbin assembly 264 is activated by selecting plate terminals 280 and 282.

By selecting plate terminals 274 and 278, both coils of the first bobbin assembly 262 are activated with greater electrical resistance provided by the increased number of wire windings of the second coil. The exemplary electrical configuration of FIG. 10B conveys how multiple coils of each bobbin assembly 262/264 are concurrently activated by selecting plate terminals 274, 278, 280, and 284. Hence, the various plate terminals 268 in association with the assorted bobbin terminals 208 allows for selective activation of one or more coils in each connected bobbin assembly 262/264.

As a result of the dual coil bobbin assemblies 262/264, nine different pickup configurations can be selected, each of which has different impedance, magnetic, and acoustic properties that provide diverse acoustic generation to a user without adding nine separate single-coil bobbin assemblies to an instrument. It is noted that the selection of various coils can provide matching, or mismatching, electrical impedances between the bobbin assemblies 262/264. The ability to selectively utilize different electrical impedances, such as impedances differences of 100, 500, 1000, or more ohms, allows for a broad range of useful sonic properties from a single pickup 260.

In some embodiments, a single bobbin assembly is utilized without a humbucking counterpart bobbin assembly. Such a configuration may, or may not, employ a baseplate 266, but can provide selective activation of different wound coils that correspond with different magnetic properties that translate to different sound characteristics. Regardless of the humbucking configuration of a pickup, the use of a bobbin assembly with more than one coil allows for precise, or vast, alterations to the manner in which string movement and vibration translates to outputted electrical signals depending on the structural configuration of the coils.

Figure 11:
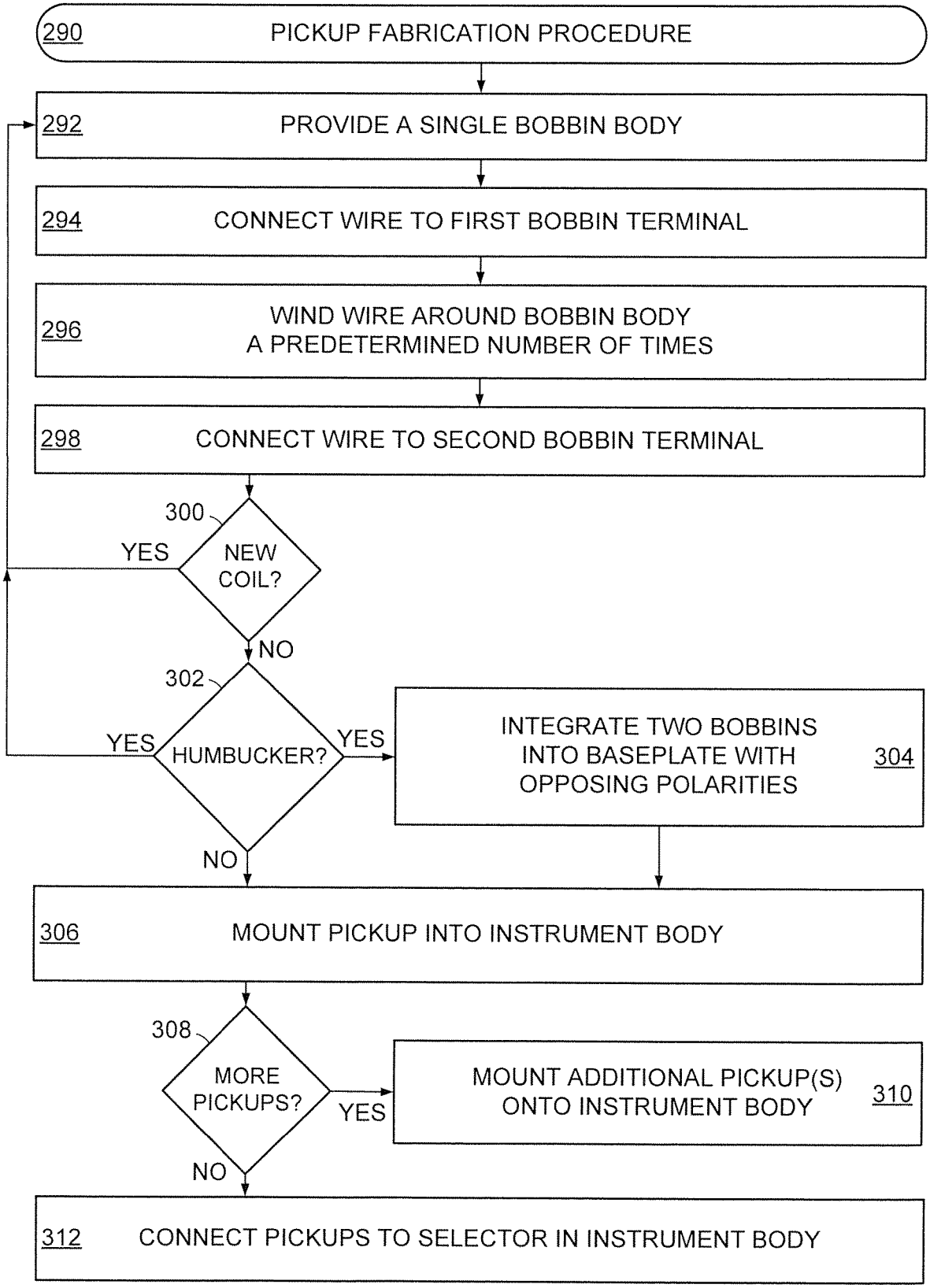
FIG. 11 conveys an example pickup fabrication routine that can be performed to produce a multiple coil pickup in accordance with assorted embodiments.

FIG. 11 displays an example pickup fabrication procedure 290 that can produce one or more multiple coil pickups configured in accordance with some embodiments. A single bobbin body is provided in step 292 with at least three electrical terminals and one conductive pole piece. An electrically conductive wire is connected to a first terminal extending from the bobbin in step 294 and is subsequently wound around the perimeter of the bobbin body a predetermined number of times, such as 2500, 4000, 5000, or more, in step 296 to create a first coil. The second end of the wire is then connected to a second terminal extending from the bobbin body, which allows electrical current to flow through the first coil upon selection of the first and second terminals. It is noted that the winding of a coil about the bobbin body can be restricted to less than all the available surface area of the bobbin, as generally shown in FIG. 8.

Decision 300 next evaluates if additional electrical coils are to be incorporated into the pickup. If so, procedure 290 cycles to step 292 where a new coil is connected between two terminals of the single bobbin body. It is contemplated that the generation of new may connect to a wire end to a terminal connected to a different coil. That is, different coils may share a bobbin terminal. Through the repeated execution of decision 300, any number of coils can be incorporated into a single bobbin body, as long as there is enough separate terminals to select individual coils. Hence, the number of coils may be limited to a function of the number of separate bobbin terminals, such as one more terminal than the number of coils.

Once decision 300 determines no additional coils are to be constructed on a single bobbin, decision 302 evaluates if the constructed bobbin assembly will be part of a humbucking pickup arrangement, as discussed in regard to FIGS. 3 & 5. A choice of a humbucking pickup arrangement first cycles back to step 292 where a second bobbin assembly is constructed. It is contemplated that the second bobbin assembly can have a single coil, or multiple coils. The completed second bobbin assembly triggers decision 302 to integrate the first and second bobbin assemblies into a baseplate in step 304 that produces opposite magnetic polarities in the respective bobbin assemblies via one or more magnets. Step 304 can involve connecting, and securing, various wires to the assorted bobbin assembly terminals.

Regardless of whether a humbucking pickup arrangement is constructed, step 306 mounts the pickup to stringed instrument. The mounting of step 306 may involve mounting other pickups on the stringed instrument with each pickup being physically separated so that the magnetic profile of the respective bobbins do not interfere with one another. The respective pickups are then wired to one or more electronic selectors in step 308. The selector(s) can be configured to allow the various pickups, or coils of the multi-coil pickup, to be activated individually, or concurrently. The ability to selectively activate less than all the pickups of a stringed instrument can provide diverse magnetic field interactions with moving adjacent instrument string(S) that translate to different streams of electrical signals and different subsequent musical playback when the stringed instrument is played.

Figure 12:
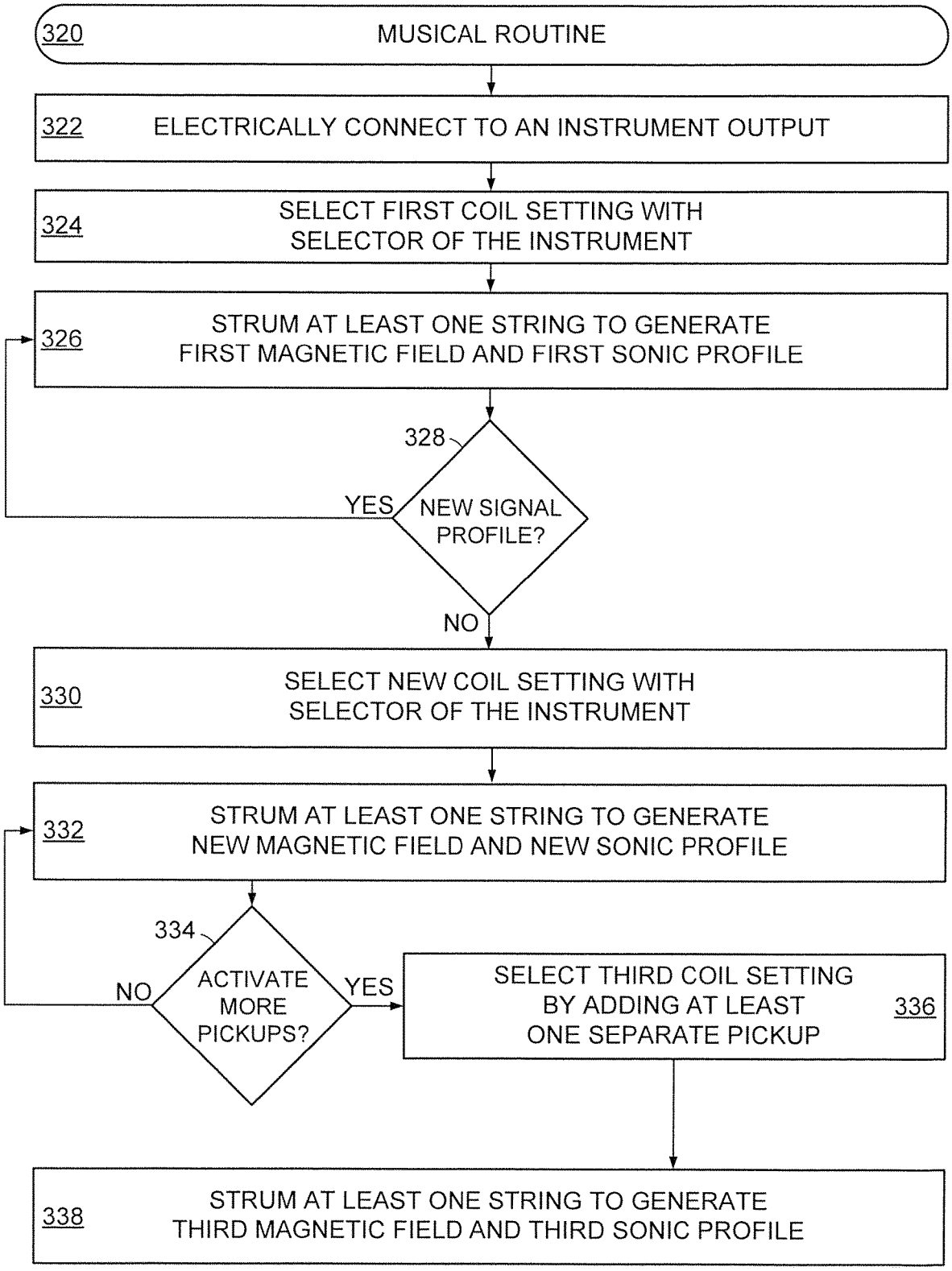
FIG. 12 is an example musical routine that can executed with one or more multiple coil pickups as part of a stringed instrument to detect and transmit musical sound.

FIG. 12 conveys an example musical routine 320 that employs the stringed instrument and one or more pickups constructed and assembled in procedure 290 in accordance with various embodiments to generate optimized electrical representation of the characteristics of a played string. With an assembled stringed instrument, step 322 electrically connects the instrument to one or more external signal processing components, such as an amplifier, control board, or broadcast transceiver. The electrical connection is contemplated as an electrical cable being plugged into a compatible jack, but other wired, or wireless, electrical connections can be utilized.

Step 324 involves a user of the stringed instrument selecting a pickup coil setting. Such selection can be conducted by physically articulating a selector of the instrument, such as a knob, lever, or button, or can be conducted remotely, such as via an external control board or amplifier. A selected coil setting corresponds with an electrical current flowing through a predetermined coil of at least one pickup, which may be less than all the available coils of a single bobbin, pickup, or instrument. The movement of a string within the magnetic field in step 326 induces a current in the selected pickup coil(s) which produces a stream of electrical signals with a first sonic profile.

It is contemplated that an electrical signal sonic profile for a played instrument string corresponds with how the magnetic field interacts with string motion, which results in the generation of a stream of electrical signals that represent audible frequencies that differ from those received by a human ear in response to a string motion. For instance, an electrical signal sonic profile may have attenuated low, mid, or high audible frequencies, increased gain for less than all the audible frequencies produced by string motion, or reduced gain for less than all the audible frequencies produced by string motion. It is noted that step 326 may be conducted any number of times for one or more strings while the first coil setting continuously provides the first electrical signal sonic profile.

Next, decision 328 evaluates if a new signal sonic profile is to be utilized. If not, step 326 is revisited and the first profile remains for any strummed strings. If a new coil setting and profile are called for, step 330 proceeds to select a new coil setting that corresponds with a new signal profile that differs from the first profile. The new second coil setting can provide a different electrical impedance and/or electrical current than the first coil setting to produce a different magnetic field that results in the generation of differing signal sonic profiles. The new coil setting selected in step 330 may select additional, or fewer, coils in a single bobbin or in a single pickup in a humbucking pickup arrangement. The new second signal profile is then outputted from the instrument in step 332 in response to the strumming of at least one string.

At any time after the selection of the second coil setting, decision 328 can evaluate if a new coil setting, and the corresponding electrical signal sonic profile, is to be selected. Accordingly, steps 330 and 332 can be executed any number of times to select any number of available different coil settings and electrical signal sonic profile from a single pickup.

Similarly, at any time after the selection of the first coil setting, decision 334 can evaluate if additional pickups of the stringed instrument are to be activated. A choice of additional pickups prompts step 336 to select at least one additional pickup with a selector prior to strumming at least one string in step 338 to produce a stream of electrical signals having a new sonic profile that differs from the electrical signal sonic profile produced from a single pickup, at least due to the additional pickup's separated location from the multi-coil pickup that has a different relative position relative to the tensioned instrument strings. It is noted that a newly activated, and physically separated, pickup from step 336 can comprise multiple coils, or a single coil, wound around a single bobbin.

Through the various embodiments of the present disclosure, a user is provided with greater tonal options from an electric stringed instrument than from single coil pickups. The ability to select different coils wound on a single bobbin, which have different coil electrical and physical configurations, allows for customization of how the magnetic field of the pickup behaves to produce a stream of electrical signals without taking up greater physical real estate on the stringed instrument. Such magnetic field behavior customization provides a user with greater tonal output control from the stringed instrument that optimizes how the stringed instruments sounds to an audience through a transducing speaker.

Even though numerous characteristics and advantages of the various embodiments of the present disclosure have been set forth in the foregoing description, together with details of the structure and function of various embodiments of the disclosure, this detailed description is illustrative only, and changes may be made in detail, especially in matters of structure and arrangements of parts within the principles of the present disclosure to the full extent indicated by the broad general meaning of the terms in which the appended claims are expressed.

What is claimed is:

1. A method comprising:

providing a pickup with a first coil and a second coil each continuously extending around a plurality of pole pieces on a single bobbin body;

connecting each coil to a selector;

selecting a first coil setting with the selector to activate the first coil alone and produce a first magnetic field about the plurality of pole pieces;

generating a first stream of electrical signals with the first magnetic field by manipulating at least one tensioned string positioned within the first magnetic field, the first stream of electrical signals representing a first set of audible frequencies produced by the at least one tensioned string;

selecting a second coil setting with the selector to activate the second coil and produce a second magnetic field about the plurality of pole pieces; and generating a second stream of electrical signals by manipulating at least one tensioned string within the second magnetic field, the second stream of electrical signals representing a second set of audible frequencies produced by the at least one tensioned string.

2. The method of claim 1, wherein the single bobbin body of the pickup supports at least one pole piece of plurality of pole pieces and the stringed instrument comprises a plurality of strings, the single bobbin body mounted to the stringed instrument to position the respective pole pieces of the plurality of pole pieces in vertical alignment with the respective strings of the plurality of strings.

3. The method of claim 1, wherein the first coil is wound a first number of times around the single bobbin body and the second coil is wound a second number of times around the single bobbin body, the first number of times is greater than the second number of times.

4. The method of claim 1, wherein a first wire of the first coil has a first length and a second wire of the second coil has a second length, the first and second lengths being different.

5. The method of claim 1, wherein a first wire of the first coil is positioned between a second wire of the second coil and the single bobbin body.

6. The method of claim 1, wherein a separate bobbin body has a third wire extending between first and second terminals of the second bobbin body, the second bobbin body mounted to the stringed instrument.

7. The method of claim 6, wherein the single bobbin body and separate bobbin body are each attached to a common baseplate in a humbucking arrangement.

8. The method of claim 7, wherein the respective terminals of the single and separate bobbin bodies each extend through the baseplate and are connected to a selector.

9. The method of claim 1, wherein a third wire is continuously wound around the single bobbin body and electrically extends between fourth and fifth terminals of the single bobbin body.

10. The method of claim 1, wherein the first and second stream of electrical signals are different.

11. The method of claim 1, wherein the first coil setting has a different impedance than the second coil setting.

12. The method of claim 1, wherein the first and second coils are concurrently activated in the second coil setting.

13. The method of claim 1, wherein playback of the first steam of electrical signals differs from the first set of audible frequencies.

14. The method of claim 1, wherein the first stream of electrical signals attenuate at least some of the first set of audible frequencies.

15. The method of claim 1, wherein the first magnetic field attenuates at least some of the first set of audible frequencies when translating the first set of audible frequencies into the first stream of electrical signals.

16. The method of reproducing sound of claim 1, wherein the selector is external to the instrument.

17. The method of reproducing sound of claim 1, wherein a third coil setting activates the first and second coils of the first pickup concurrently with the first coil of the second pickup.

18. The method of reproducing sound of claim 1, wherein the second coil setting activates the second coil alone.

19. A method of reproducing sound comprising:

providing an instrument comprising a first pickup and a second pickup each positioned in vertical alignment with a plurality of strings;

selecting a first coil setting with a selector to activate a first coil of the first pickup alone and produce a first magnetic field about the plurality of strings;

translating movement of at least one string of the plurality of strings into a first stream of electrical signals with a first magnetic field produced with the first coil setting;

selecting a second coil setting with the selector to activate a second coil of the first pickup and produce a second magnetic field about the plurality of strings, the first and second coils of the first pickup each wrapped around a single bobbin body;

translating movement of at least one string of the plurality of strings into a second stream of electrical signals with a second magnetic field produced with the second coil setting;

selecting a third coil setting with the selector to activate a first coil of the second pickup and produce a third magnetic field about the plurality of strings; and translating movement of at least one string of the plurality of strings into a third stream of electrical signals with a third magnetic field produced with the third coil setting.

* * * * *